US005872855A

United States Patent [19]

Porrazzo et al.

[11] Patent Number: 5,872,855

[45] Date of Patent: Feb. 16, 1999

[54] MULTIPLE VOICE COIL, MULTIPLE FUNCTION LOUDSPEAKER

[75] Inventors: Edward M. Porrazzo; Karen Pamela Orell-Porrazzo, both of Carmichael, Calif.

[73] Assignee: Chain Reactions, Inc., Gold River, Calif.

[21] Appl. No.: 409,252

[22] Filed: Mar. 22, 1995

[51] Int. Cl.[6] ..... H04R 25/00

[52] U.S. Cl. ..... 381/194; 381/196; 381/203; 181/153; 181/196; 181/148; 181/198; 181/199

[58] Field of Search ..... 381/194, 203, 381/204, 190, 191, 192, 193, 195, 196, 197, 202; 181/153, 196, 148, 198, 199

[56] References Cited

U.S. PATENT DOCUMENTS

| | | | |
|---|---|---|---|
| 3,783,202 | 1/1974 | Bobb . | |
| 4,039,044 | 8/1977 | Heil . | |
| 4,341,930 | 7/1982 | Steinle et al. . | |
| 4,426,556 | 1/1984 | Saiki et al. . | |
| 4,438,297 | 3/1984 | Kawamura . | |
| 4,612,420 | 9/1986 | Nieuwendijk et al. . | |
| 4,756,382 | 7/1988 | Hudson, III | 381/156 |
| 4,759,005 | 7/1988 | Kasahara . | |
| 4,837,838 | 6/1989 | Thigpen et al. | 381/196 |
| 4,965,839 | 10/1990 | Elieli . | |
| 5,003,609 | 3/1991 | Muraoka . | |
| 5,231,672 | 7/1993 | Tsao | 381/203 |
| 5,297,214 | 3/1994 | Bruney . | |

FOREIGN PATENT DOCUMENTS

| | | | |
|---|---|---|---|
| 55-121795 | 9/1980 | Japan | 381/194 |
| 63-279700 | 11/1988 | Japan | 381/194 |

*Primary Examiner*—Curtis A. Kuntz
*Assistant Examiner*—Duc Nguyen
*Attorney, Agent, or Firm*—Townsend & Townsend & Crew LLP; Guy W. Chambers

[57] ABSTRACT

Loudspeaker improvements are disclosed to add versatility and economy, particularly for multimedia applications. These improvements include: (1) the printing of voice coil conductors, (2) adding conductive elements to the sound driver surface, (3) using multiple coil paths around a single voice coil former to drive the overall sound driver surface, (4) creating a simple digital loudspeaker with multiple coil paths, (5) implementing multiple functions in the multiple coil loudspeaker/transducer, (6) creating integrated systems with a series of multiple function, multiple coil loudspeakers/transducers and (7) providing a novel sub-woofer loudspeaker housed in a cylinder.

9 Claims, 9 Drawing Sheets

MULTIPLE VOICE COIL, MULTIPLE FUNCTION LOUDSPEAKER

BACKGROUND OF THE INVENTION

This invention relates to improvements in audio loudspeakers, especially for multimedia applications.

Audio loudspeakers are a common way to transduce an electrical signal into sound waves. The audio loudspeaker accepts an electrical signal from an external source and moves a sound driver surface, such as a speaker cone, to produce sound waves. Such audio loudspeakers have been widely used in audio, computer, medical, manufacturing and other fields. However, as these loudspeakers are called upon to perform more demanding roles in advancing technology, such as in computer multimedia, home entertainment and other varied technologies, their shortcomings have become evident.

FIG. 1A is an illustration of a prior art cone loudspeaker. In FIG. 1A, loudspeaker 100 is shown in a cutaway view with primary functional components, namely voice coil former 10, voice coil 12, ferrite magnet 14 and copolymer cone 16, being visible. In operation, an electrical signal is first applied to the voice coil 12. This voice coil 12 is typically a single strand of wire wrapped many times around coil former 10. Since voice coil 12 resides close to ferrite magnet 14, voice coil 12 is immersed in a magnetic field created by the ferrite magnet 14. As electricity flows through the voice coil 12, a magnetic field is created which interacts with the permanent magnetic field of the ferrite magnet 14. This interaction between the magnetic fields of the voice coil 12 and the ferrite magnet 14 creates movement of the attached cone 16 proportional to the current flowing through the voice coil 12.

FIG. 1B shows a side cutaway view of another cone loudspeaker of the prior art. FIG. 1B shows some of the same primary components of FIG. 1A, such as voice coil 12, magnet 14 and cone 16. In FIG. 1B, though, an external source providing an electrical signal is connected to contacts 20 and through leads 18 in order to drive the loudspeaker.

FIG. 1C shows an enlarged view of voice coil former 10 and voice coil 12 in another prior art cone loudspeaker, along with leads 18.

While the prior art cone loudspeaker of FIGS. 1A, 1B and 1C has been adequate to reproduce analog sound from a single source, the prior art cone loudspeaker suffers from several deficiencies, especially when called upon to perform in high-quality computer or multimedia applications. For example, the prior art cone loudspeaker has only a single voice coil wire so that it can only receive only a single signal from a single external signal source. This feature makes the prior art cone loudspeaker a single function (i.e., "play only") analog device. Even with advances in wireless signal transmission, the prior art cone loudspeaker requires digital-to-analog converters in order to process input digital signals.

Further, prior art cone loudspeaker are not equipped to deal with multiple signal sources. The single function prior art cone loudspeaker cannot monitor its environment, receive and process multiple external signals, or act as a transmitter. In typical computer multimedia applications, sound signals may originate from a variety of sources such as a computer, compact disc (CD) player, telecommunications line or speech synthesizer. In order for these multiple signal sources to be used with a single prior art cone loudspeaker, the signals must currently be combined in a "mixer." Again, this approach involves the use of additional hardware components and inevitably degrades the sound quality.

Another problem with prior art cone loudspeakers is that the conical shape of the sound surface causes undesirable distortions in the creation, projection and propagation of sound waves from the loudspeaker. FIG. 1D shows how a prior art cone loudspeaker, having a voice coil assembly 30 and cone 32, propagates sound to a point in front of the speaker cone. Beyond this point, the acoustical energy is dispersed. Further, since the surface of the cone is non-planar, the wavefronts generated at different points on the surface of the cone produce a non-linear set of sound waves. In order to alleviate this problem, the prior art uses specially designed enclosures or cabinets to house the cone loudspeakers and attempt to baffle and redirect the acoustical energies to make the sound wave propagation more linear.

Finally, FIG. 1E illustrates another problem with the manufacture of prior art cone loudspeakers. FIG. 1E shows voice coil wires 12 adjacent to voice coil former 10 in a cross-sectional view. Note that, because of the geometric packing limitations of circular objects, voice coil wires can only achieve a limited volume coverage due to the necessary gaps between different windings of the wire. While some prior art coils use rectangular extruded wire to overcome such gaps, this extruded rectangular wire creates manufacturing difficulties. Many of these manufacturing difficulties are attributable to the process costs of extruding the wire in rectangular form and then winding the wire around the voice coil former. The process of extruding wire requires forcing metal at high pressure through an extrusion die. When a sharp edged rectangular wire is created, the high pressure and abrasion of this process causes the die to wear out quickly. Moreover, the process of winding the wire around a voice coil former can be an intricate operation where the rectangular wire is fine and the number of windings are many. Accurate winding is critical where rectangular wire is used because of the wire's sharp edges. Special care must be taken so that the rectangular wire does not twist while it is being wound around the voice coil former. If the rectangular wire twists, even slightly, there is the danger that a sharp edge will cut through the thin insulation surrounding the wire and cause a short in the coil. This problem is all the more troublesome because the short may not actually take place until after the coiled wire has been tested and placed into a service environment where added stresses due to operation, such as heat, bring about a short circuit.

In view of the these disadvantages with prior art cone loudspeakers, it is desirable to produce a loudspeaker that overcomes these disadvantages.

SUMMARY OF THE INVENTION

The present invention has numerous aspects. These aspects include: (1) the printing of voice coil conductors, (2) adding conductive elements to the sound driver surface, (3) using multiple coil paths around a single voice coil former to drive the overall sound driver surface, (4) creating a simple digital loudspeaker with the multiple coil paths, (5) implementing multiple functions in the multiple coil loudspeaker/transducer, (6) creating integrated systems with a series of multiple coil, multiple function loudspeakers/transducers and (7) providing a novel subwoofer loudspeaker housed in a cylinder.

One aspect of the present invention is to form a voice coil by printing conductors, such as conductive ink, on an insulating material and affixing the printed conductor to a substrate carrier. This printing approach can greatly simplify the process of manufacturing and applying voice coils to a cone type loudspeaker and result in numerous economies.

A second aspect of the present invention is adding conductive coils to the sound driver surface in order to complement the sound produced by the sound driver surface as a whole. These additional conductive coils can take the form of a series of variable geometry planar coils or can be "sound pixel" dots. In operation, the sound driver surface as a whole may be producing low frequency sound while the additional conductive coils printed on the sound driver surface can produce mid-to-high frequency sound.

A third aspect of the present invention is the use of multiple coils formed around a single voice coil former to drive the overall sound driver surface. The use of multiple coils allows, among other things, input of information to the loudspeaker from multiple sources. Through the use of multiple coils, these multiple sources can either drive the loudspeaker simultaneously or sequentially.

A fourth aspect of the present invention is the use of multiple coils to create a simple digital loudspeaker. In the prior art, the single voice coil cone loudspeaker was an analog device that responded only to analog signals. To the extent digital signals were sent to the prior art cone loudspeaker, they would have to be converted to analog signals with a digital-to-analog converter (DAC). In the present invention, different voice coils can be made with different numbers of windings or otherwise assigned different binary values in order to directly accept digital signals without the need of a digital-to-analog converter.

A fifth aspect of the present invention is the use of a multiple coil loudspeaker/transducer to perform various functions such as receiving, monitoring, transmitting and transducing. The use of multiple voice coils in conjunction with a microprocessor, such as a transducer processing unit (TPU), allows the loudspeaker/transducer to monitor the qualitative conditions of the loudspeaker/transducer's operations as well as its physical operating environment. Based upon this monitoring function, the loudspeaker/transducer can then make adjustments to its output.

A sixth aspect of the present invention is the ability of a series of such multiple coil, multiple function loudspeakers/transducers to perform with versatility in a multimedia environment. By both producing sound and sensing ambient characteristics such as temperature and pressure from a number of locations, a series of multiple coil, multiple function loudspeakers/transducers can optimize loudspeaker/transducer performance throughout a broad area.

A seventh aspect of the present invention is a novel subwoofer assembly housed in a cylinder. This subwoofer assembly uses its novel construction in conjunction with other aspects to achieve better performance and efficiency than conventional subwoofers.

Finally, other aspects of the present invention will become apparent from a reading of the "Detailed Description of Preferred Embodiments" and a review of the accompanying drawings.

DETAILED DESCRIPTION OF PREFERRED EMBODIMENTS

The present invention has numerous aspects which contribute to the versatility and economy of loudspeaker/transducer design and performance, particularly in a multimedia environment.

1. Printed Voice Coil Conductors

Figure 1A:
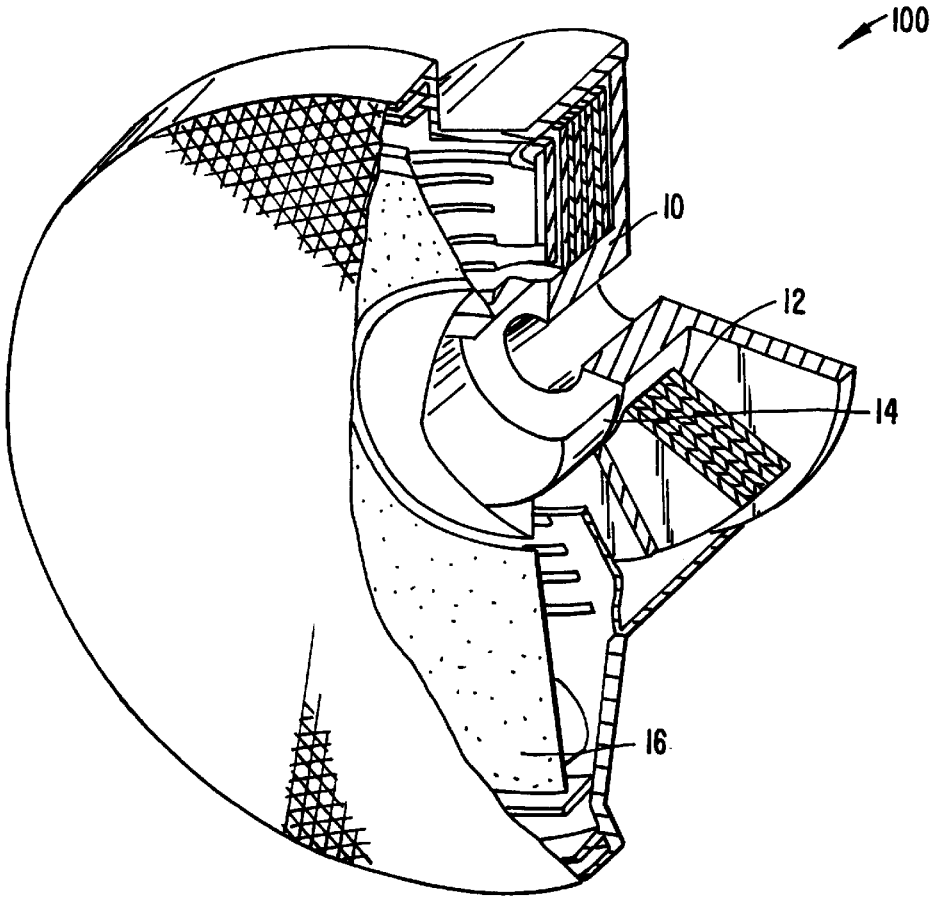
FIG. 1A. PRIOR ART
FIG. 1A is a cutaway illustration representative of a prior art cone loudspeaker.
Figure 1B:
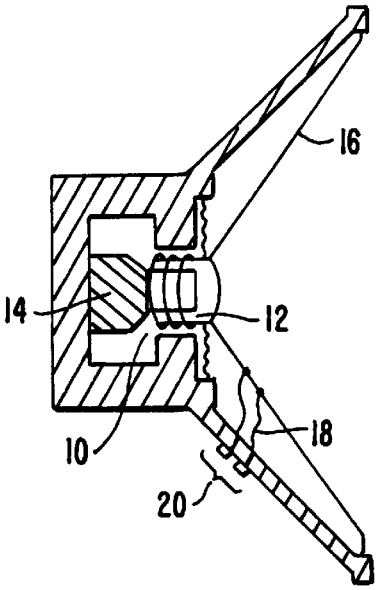
FIG. 1B. PRIOR ART
FIG. 1B shows a cross-section view of a cone loudspeaker of the prior art.
Figure 1C:
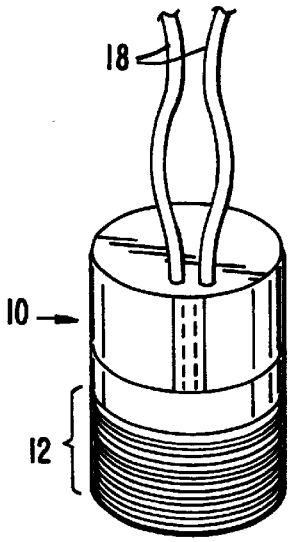
FIG. 1C. PRIOR ART
FIG. 1C shows an enlarged view of a voice coil former, voice coil and leads of a prior art cone loudspeaker.
Figure 1E:
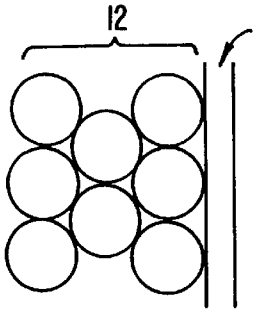
FIG. 1E. PRIOR ART
FIG. 1E shows a cutaway view of circular voice coil wires adjacent to a voice coil former in a prior art cone loudspeaker.
Figure 1D:
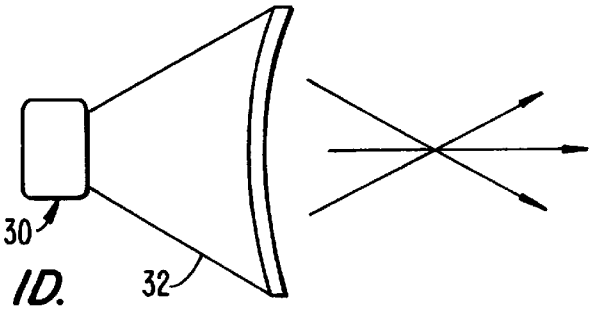
FIG. 1D. PRIOR ART
FIG. 1D shows how sound propagates from a prior art cone loudspeaker.
Figure 2A:
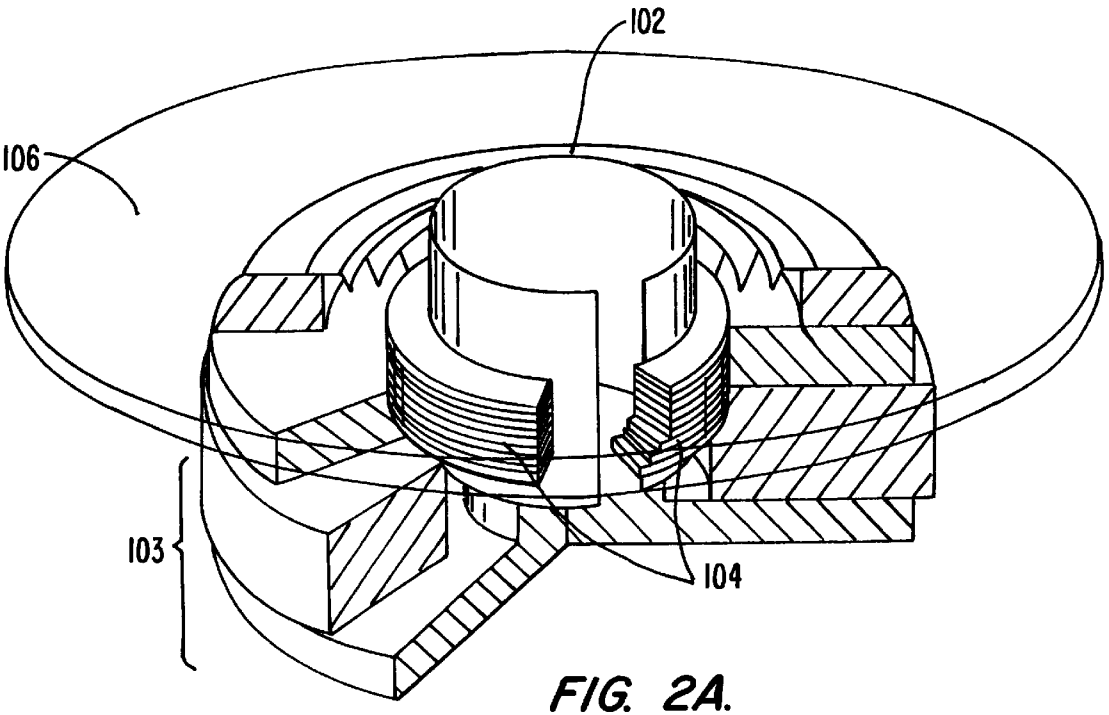
FIG. 2A shows a cutaway illustration of the loudspeaker of the present invention with a planar sound driver surface.

Rather than using round or rectangular wire as in prior art cone loudspeakers, the voice coil conductors of the present invention are preferably formed of conductive ink. FIG. 2A shows a cutaway illustration of a preferred loudspeaker of the present invention. In FIG. 2A, the loudspeaker 103 is shown having voice coil former 102, driver surface 106 and voice coil conductors 104. In the illustration of FIG. 2A, voice coil conductors 104 are shown comprised of a single printed conductor wound around voice coil former 102. This printed conductor 104 incorporates conductive ink, such as Ormet 2000 conductive ink produced by Toranaga Industries of Carlsbad, Calif., and is encased in insulator material. This insulator material can preferably be paper, polymeric material or even insulating ink.

Figure 3A:
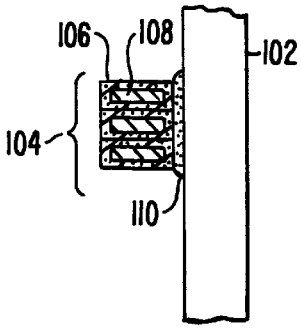
FIG. 3A shows an enlarged cross-section of the printed voice coil windings and voice coil former of FIG. 2A.

FIG. 3A shows an enlarged cross-section of the printed voice coil conductor 104 and voice coil former 102 of FIG. 2A. In FIG. 3A, printed voice coil conductor 104 includes three representative loops of printed conductor. Each loop of the printed conductor shows an outer insulating material 106 surrounding an inner conductive layer 108. The loops of the printed conductor may be fixed to voice coil former 102 with a common, heat resistant adhesive as shown by adhesive layer 110.

In FIG. 3A, the printed conductor cross-section is rectangular. Referring to the longer cross-sectional dimension in FIG. 3A as the "length" and the shorter cross-sectional dimension as the "width." The printed conductor in FIG. 3A is oriented so that the width dimension is adjacent to voice coil former 102.

Figure 3B:
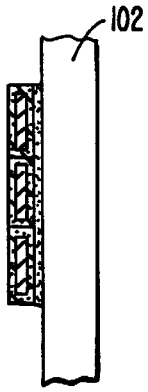
FIG. 3B shows an alternative arrangement of a printed voice coil windings and voice coil former of FIG. 2A.

FIG. 3B shows an alternative arrangement of the printed conductor where the length dimension is adjacent to voice coil former 102.

Figure 3C:
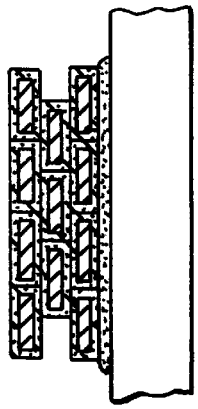
FIG. 3C shows a multilayer arrangement of printed voice coil windings on the voice coil former of FIG. 2A.

FIG. 3C shows a case where the arrangement of FIG. 3B is used to form printed voice coil windings in three layers. Note that each successive layer is offset, or "staggered," from the previous layer. Many configurations for orienting and layering the printed conductors will be apparent and are within the scope of the present invention.

Figure 3D:
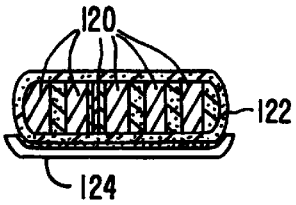
FIG. 3D shows one arrangement of multiple printed voice coil conductors contained within an insulating material.

FIG. 3D shows multiple printed conductors 120 contained within an insulating material 122 and affixed to a substrate carrier 124. Substrate carrier 124 can be formed of any suitable flexible insulating material, such as paper or polymeric material or insulating ink.

Figure 3E:
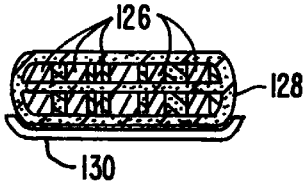
FIG. 3E shows an alternative arrangement of multiple printed voice coil conductors contained within an insulating material.

FIG. 3E shows another arrangement of multiple conductors surrounded by insulating material. In FIG. 3E, multiple conductors 126 are of different sizes but still encased within insulating material 128 and affixed to substrate carrier 130. Different size conductors provide different electrical properties that can be assigned to different input/output devices, as discussed below in connection with the multiple path aspects of the present invention.

2. Additional Conductive Elements on the Sound Driver Surface

Figure 4:
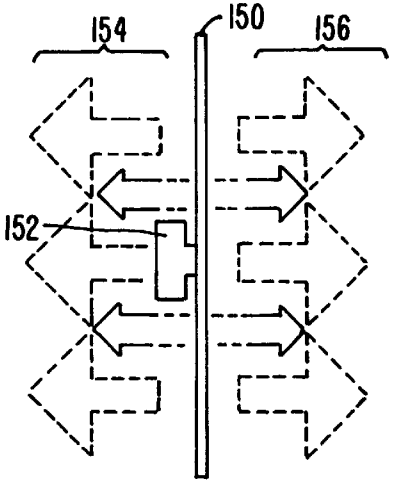
FIG. 4 illustrates sound wave propagation from a planar sound driver surface.

In the present invention, the sound driver surface can come in a variety of shapes and be driven not only by the coils wrapped around the voice coil former but also by additional coils embedded within the sound driver surface. Returning to FIG. 2A, a sound driver surface 106 is shown as a planar disk without embedded coils. This plain sound driver surface could also have been shaped as a cone design, as shown in the prior art, in rectangular form or a variety of other shapes. An advantage of using a planar surface for the sound driver surface 106 in FIG. 2A is that sound waves can be produced in both directions. As illustrated in FIG. 4, planar surface 150 is vibrated in both directions by coil assembly 152. The bidirectional "push/pull" force imparted by coil assembly 152 to planar surface 150 creates bidirectional sound waves shown as arrows 154 and 156 respectively.

The thickness of sound driver surface 106 in FIG. 2A is preferably 1–3 mils. For support, this sound driver surface can be held in place by a suitable holding frame. The material used for the sound driver surface is preferably Kapton, but may also be Mylar, paper or a variety of other flexible, acoustically reflective materials.

Figure 2B:
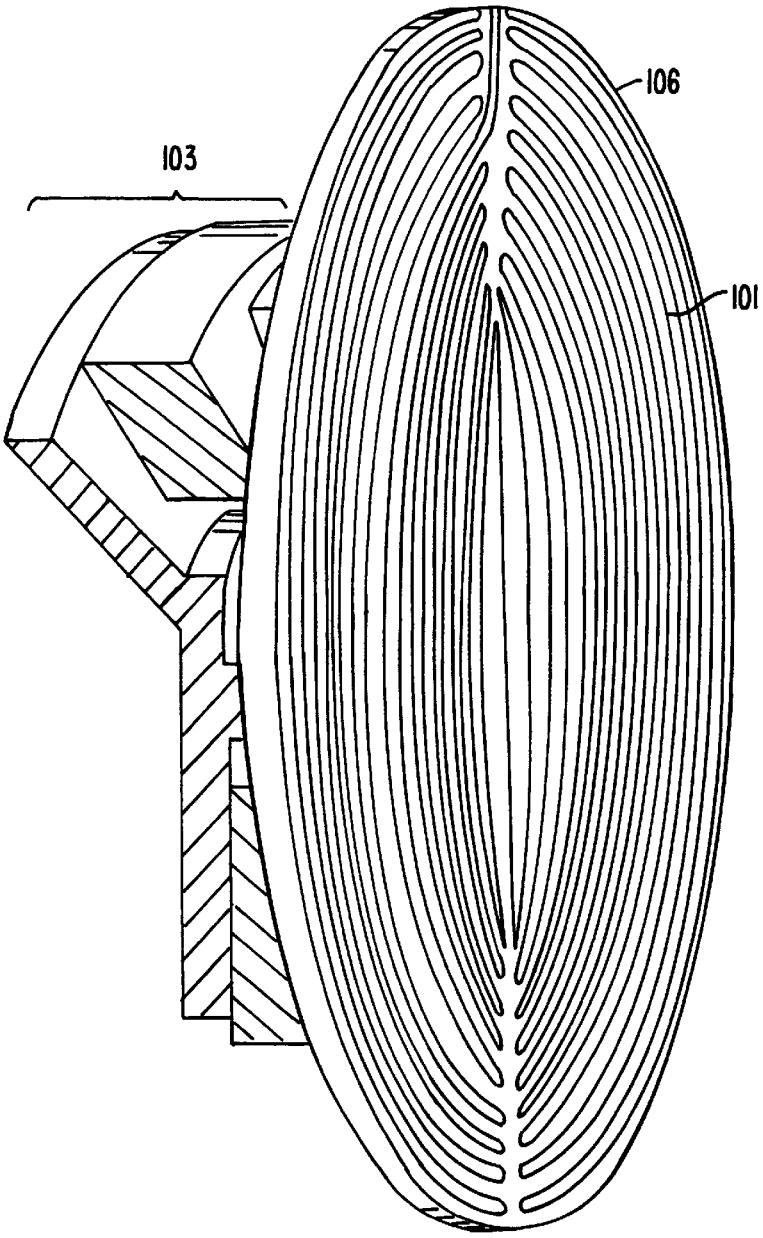
FIG. 2B shows additional planar coils formed on a sound driver surface of the present invention.

In order to add versatility to the performance of the loudspeaker in the present invention, voice coils can be added to the surface of the sound driver. Such an arrangement is shown in FIG. 2B where planar coils 101 are formed on the surface of sound driver 106. Sound driver surface 106, as a whole, is moved by the same magnet and voice coil assembly 103 used in FIG. 2A. However, since sound driver surface 106 is provided with conductive paths in the form of planar coils 101, sound driver surface 106 may further be driven by current flowing through planar coils 101 to the extent that the planar coils 101 are positioned within a magnetic field. A magnetic field may be created about planar coils 101 by any means known in the art, including use of a ferrite magnet as shown in FIG. 2A or by placing such magnets within the sound driver surface 106 itself as described in Applicants' copending U.S. patent application Ser. No. 08/132,652, which is incorporated by reference.

Figure 2C:
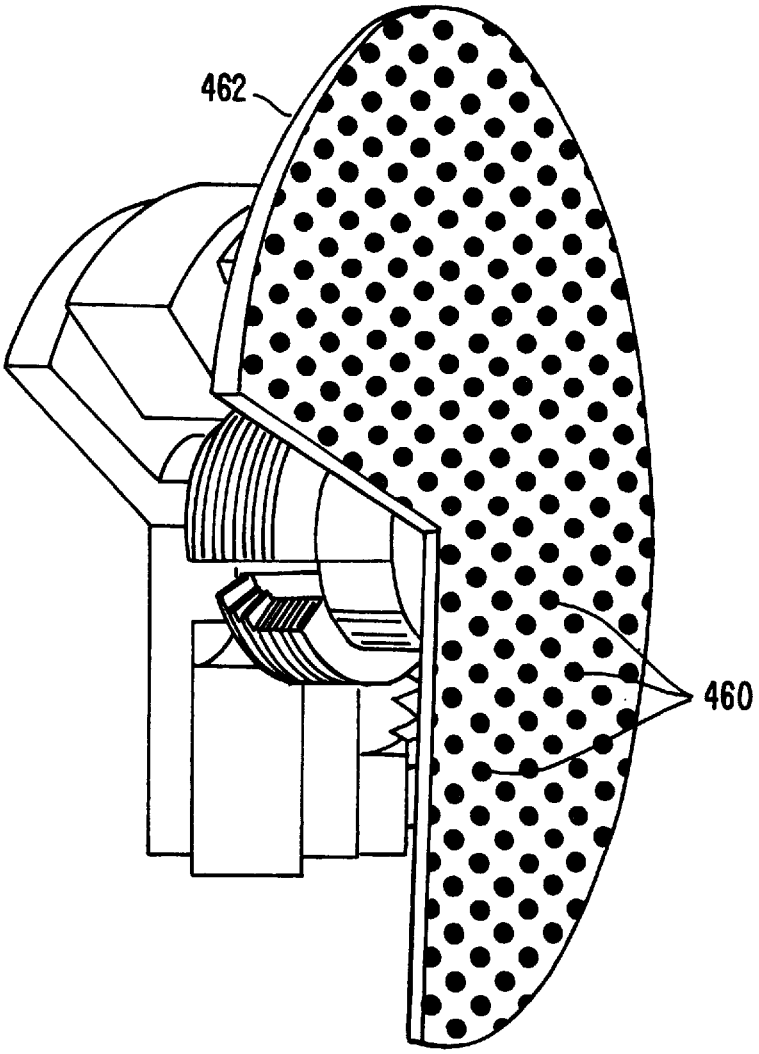
FIG. 2C shows sound pixel elements formed on a sound driver surface of the present invention.

FIG. 2C shows yet another approach to placing complementary conductive elements in a sound driver surface. In FIG. 2C, "sound pixel" elements 460 are formed in sound driver surface 462 as discrete areas of conductive material. In FIG. 2C, these sound pixels 460 take the form of dots of conductive material, such as dots of conductive ink. As shown in FIG. 2E, the sound pixels 466 can be connected together as desired with lines of conductive material 467 to act in unison. Alternatively, the sound pixels 466 can be independently addressable regions activated under the control of, for example, a transducer processing unit (TPU), to cause a vibration on the sound driver surface at the location of each particular sound pixel 466. FIG. 2E also shows that sound pixel elements 466 can be made in different sizes and shapes.

Figure 2D:
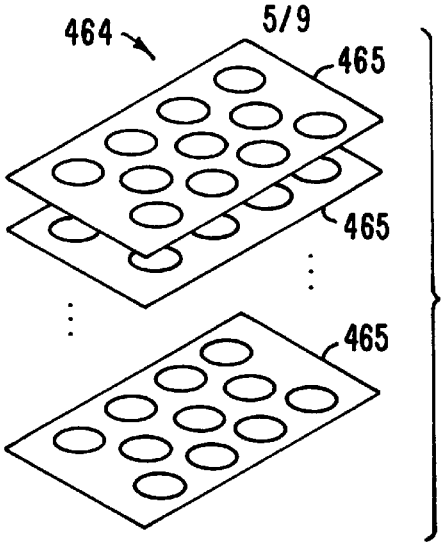
FIG. 2D shows multiple layers of sound pixel elements on a sound driver surface of the present invention.
Figure 2E:
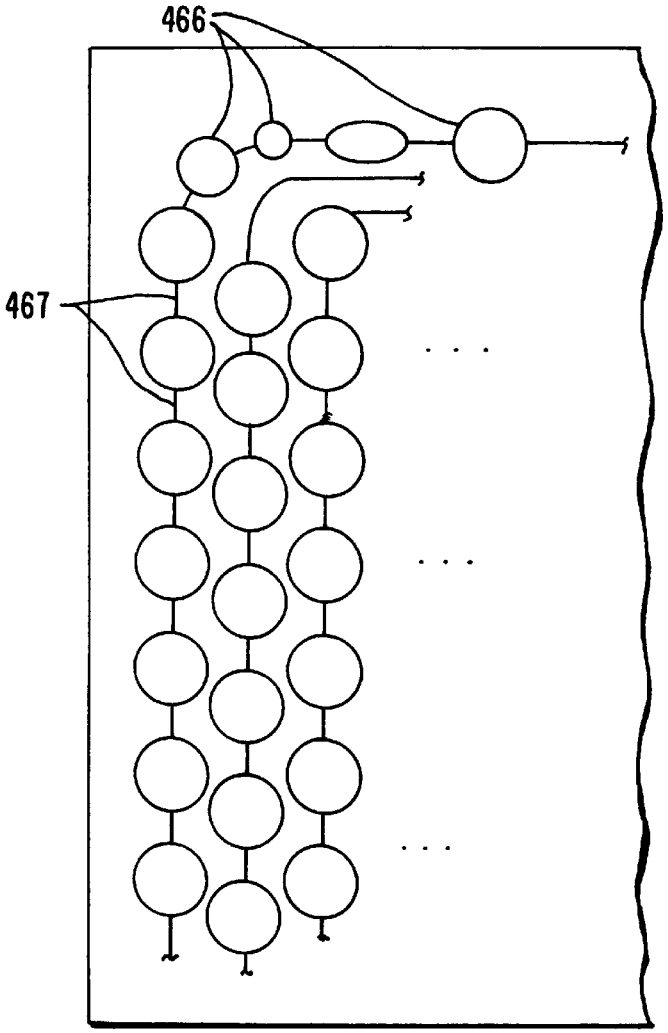
FIG. 2E shows how sound pixels can be of varied shapes and sizes.

FIG. 2D shows multi-layered diaphragm 464 incorporating the "sound pixel" concept. Preferably, each sound pixel layer 465 is separated from surrounding sound pixel layers with insulating material. Nonetheless, in one embodiment, holes can be selectively left in the insulating layer between adjoining sound pixels to allow those sound pixels to physically contact one another and thereby work as one. In another multi-layer "sound pixel" embodiment, though, the interconnection between the sound pixels occurs not by physical contact, but through induction.

Alternatively, the sound pixels in different layers may be formed in a grid arrangement. For example, one layer may have a series of parallel horizontal conductor lines while the adjoining layer would have a series of parallel vertical conductor lines. In that case, each of the sound pixels could be the intersections of these horizontal and vertical lines. To activate an individual sound pixel, one would simply activate the particular horizontal and vertical lines whose intersection defines that sound pixel. If desired, this intersecting point can be made physically larger to cause more transduction with the permanent magnet when that particular sound pixel is activated.

By using placing additional coils or sound pixels on the sound driver surface, a "speaker on a speaker" is in effect created. This "speaker on a speaker" allows, for example, the coils or sound pixels on a sound driver surface to act as a "tweeter" to handle mid and high frequencies while the coil assembly and sound driver surface as a whole serves to handle low frequencies and act as a "woofer." Also, this "speaker on a speaker" arrangement eliminates the need for multiple "tweeter", "mid-range" and "woofer" loudspeakers as in the prior art and thereby reduces the size and cost of the enclosure needed because only a single loudspeaker assembly is used.

3. Multiple Voice Coil Paths

Figure 3F:
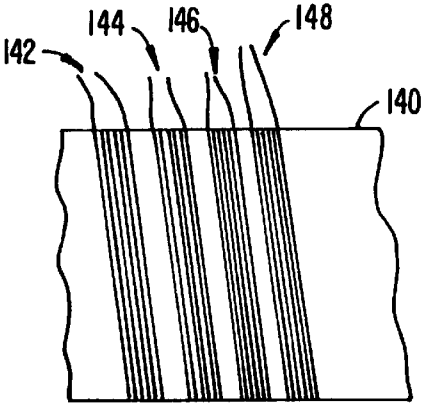
FIG. 3F shows how multiple voice coil conductor paths can be formed around a single voice coil former.

Rather than relying on a single coil around the voice coil former as in the prior art, the present invention uses multiple voice coil paths around the voice coil former to enhance the versatility of the loudspeaker, particularly in multimedia applications. FIG. 3F shows multiple conductors 142, 144, 146 and 148 formed around a single voice coil former 140. In this case, each of the multiple conductor coils 142, 144, 146 and 148 rest side by side with a buffer area separating them. Nonetheless, the multiple conductors coils may be laid on the voice coil former 140 in many other ways. For example, they may overlap each other in a layered fashion, may criss-cross or may be interleaved loop-by-loop. While printed conductors are the preferred conductor for the present invention, one in the art will quickly recognize that multiple coils can also be made of extruded wire, conductor buses or any other form of conductor that is suitably insulated. As explained in more detail later, the multiple conductor coils can also have different numbers of windings.

Figure 5:
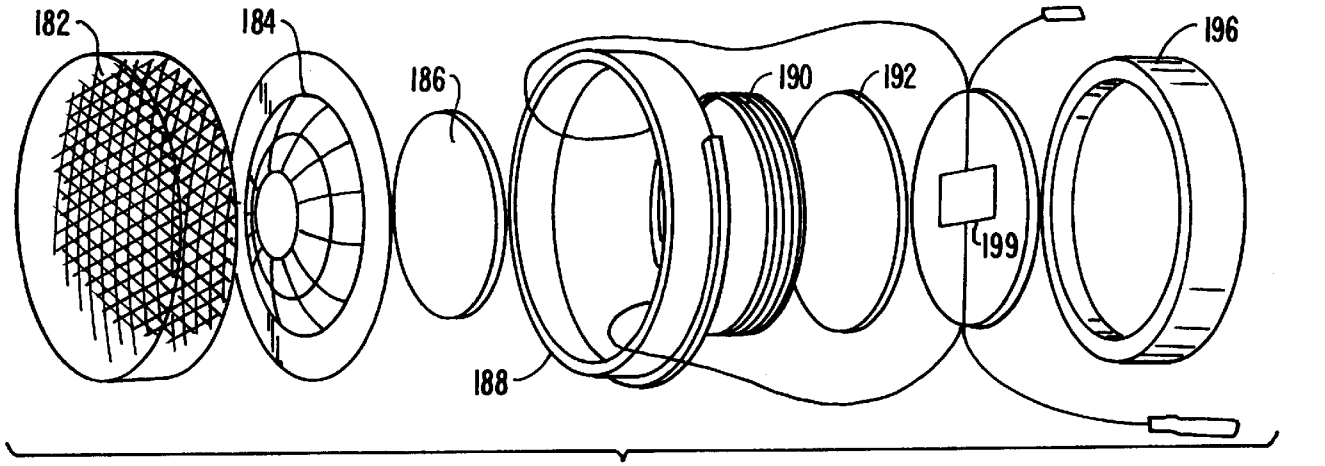
FIG. 5 shows an exploded view of a preferred embodiment of the present invention using multiple voice coil paths in conjunction with a single voice coil former, a bus connected to the multiple voice coil paths and to a transducer processing unit (TPU) to coordinate inputs to the multiple voice coil paths.

To obtain full benefit of the multiple coils, a "bus" arrangement and transducer processing unit (TPU) are preferably used with the multiple coils. FIG. 5 shows an exploded view of a preferred embodiment of the present invention that uses multiple voice coil conductors 190, a bus and a TPU 194. In FIG. 5, the speaker 180 also includes grill 182, sound driver surface 184, damping plug 186, voice coil former 188, permanent magnet 192 and yoke assembly 196. In FIG. 5, magnet 192 creates a magnetic field so that when current is passed through one or more of the conductors in voice coil conductor 190, a force is imparted to sound driver surface 184.

TPU 194 can be designed and constructed as a common digital controller. For example, TPU 194 can include a digital microprocessor, application specific integrated circuits or other logic devices. Moreover, the TPU can communicate with standard digital buses such as the small computer systems interconnect (SCSI) bus interface from Adaptech, Inc., or the personal computer interconnect (PCI) bus, both of which are compatible with International Business Machines' (IBM's) personal computer (PC). Another example of a standard bus that can work with the TPU 194 of the present invention is a musical instrument digital interface (MIDI). Depending on the complexity of the application, TPU 194 may be highly complex or can simply be a digital switch with small-scale integrated control circuitry. TPU 194 can, in the most primitive case, simply be a manual, or even hardwired, switch.

Figure 6:
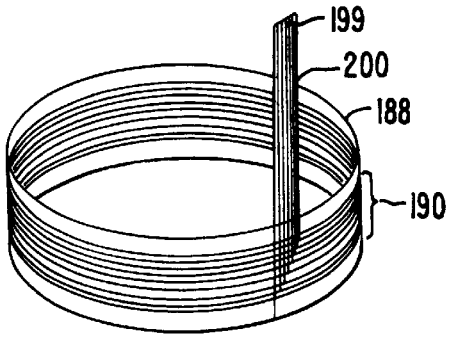
FIG. 6 shows a close-up view of how a bus would connect to the multiple voice coil paths in the loudspeaker of FIG. 5.

FIG. 6 shows a close-up of voice coil former 188 within which multiple voice coils 190 have been formed. In this embodiment, each of these voice coils is attached to a separate line of voice coil bus 200. Leads 199 at the ends of the voice coil bus 200 are used to connect the bus to additional circuitry, such as a TPU, or directly to an outside signal source.

Figure 7:
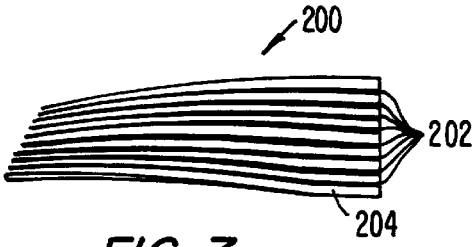
FIG. 7 shows an enlarged portion of the bus from FIG. 6.

FIG. 7 shows an enlarged portion of the multiple path conductor bus 200 of FIG. 6. In FIG. 7, eight conductors lines 202 are shown formed on substrate material 204. In a preferred embodiment, these conductor lines 202 are conductive ink printed on a non-conducting substrate 204, such as Kapton, Mylar, paper of other flexible insulating material. Naturally, any number of conductors lines may be formed on the bus. Further, the bus may contain layered sets of conductors lines separated by insulating material as shown, for example, in FIG. 3E for the printed conductor coils.

Figure 8:
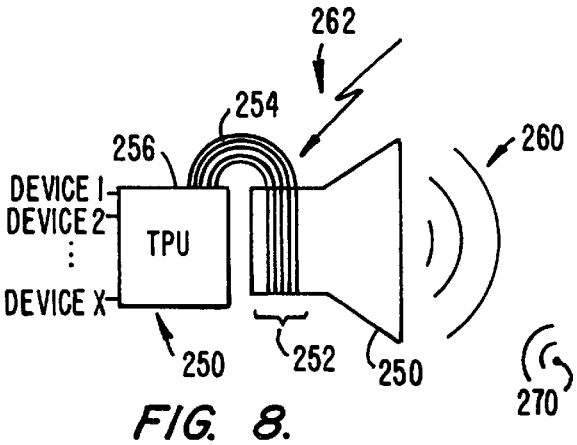
FIG. 8 illustrates the flexibility of a loudspeaker/transducer with multiple voice coil paths to accept signals from various devices and monitor environmental conditions during operation.

FIG. 8 illustrates how the multiple path conductor coils of the present invention can be used to receive inputs from multiple devices, for example in a multimedia context. In FIG. 8, loudspeaker 250 is equipped with multiple path conductor coils 252. The multiple path conductor coils use a bus arrangement 254 like that already discussed in connection with FIGS. 5–7. The bus 254 electrically connects these multiple conductor paths to a TPU 256 which can selectively send inputs to the loudspeaker from any number of devices. In one preferred embodiment, each of the devices is connected through the TPU to a separate conductor path within the multiple path conductor 252. For example, assuming the bus in FIG. 8 has eight conductive paths, device 1 of FIG. 8 can be coupled to conductive path 1, device 2 can be connected to path 2, and so on, for up to eight separate sound signal sources. Naturally, any arbitrary connection pattern can also be used so that device 1 can be connected to, for example, conductive path 4.

The present invention can also accommodate arrangements where there are more or less devices than there are conductive paths on the bus and voice coils. For example, if there are more devices than there are conductive paths on the bus and voice coils, a bus arbitration scheme can be used to prioritize which devices get access to which conductive paths on the bus and voice coils. This bus arbitration scheme can involve time multiplexing or prioritization where more important sound sources receive a larger portion of time or are even given permanent access to particular lines.

In the case where there are fewer active devices than conductive bus and voice coil paths, a single device might be connected to more than one conductive path at a time. By providing a signal source with connections to more than one conductive path, greater driving ability for the sound driver surface can be provided for a given current. Thus, louder volumes can be achieved, depending on the signal source's driving ability, by connecting multiple coil windings to a signal source. Also, when a conductive path fails, connecting a single device to multiple conductive paths can allow the defective path to be eliminated from use without resulting in the loss of the user's ability to hear the sound signal source.

4. Use of Multiple Coils to Create a Simple Digital Loudspeaker

As previously noted, the single coil cone loudspeaker of the prior art is a analog device. To the extent digital signals were sent to the prior art cone loudspeaker, they would have to be converted to analog signals with a digital-to-analog converter.

While the multiple coil path loudspeaker of the present invention can readily act as an analog device in the same manner as a prior art cone loudspeaker, it can also be configured to directly receive digital signals without the need for a digital-to-analog converter. In one embodiment, the various components of the digital signal can be directly applied to a series of identical multiple conductor coils. For example, where the digital signal consists of a 4 bit word, the TPU can apply each bit of the word to a separate coil. In other words, bits 0, 1, 2 and 3 from a digital signal source word can be applied by the TPU to lines 0, 1, 2 and 3 of the multiple coils.

In a preferred embodiment, the elements of the digital signals are assigned different values in the loudspeaker of the present invention, either by amplifying the elements differently or by giving each of the coils on the loudspeaker a different number of windings. For example, the amplification or driving force that is applied to the sound driver surface by a high signal on transducer line 0 can be made to be one-half as much as the driving force applied to the sound driver surface by a high signal on transducer line 1. Similarly, the amplification or driving force applied by a high signal on line 1 can be made one-half as much as the driving force applied by a high signal on line 2.

Alternatively, the number of windings for each coil may differ to provide a different force for the same current. For example, a first conductor can have a number, n, of windings around a voice coil former. A second conductor then can have 2n windings about the same voice coil former. A third conductor has 4n windings, a fourth conductor has 8n windings, and so on, so that each successive conductive path provides twice as many windings as the previous path. Thus, a binary system of different impedances is created to implement different values for the digital signal.

This binary system of different impedances can also be used to selectively match the voltage and current load from a particular devices with an appropriate voice coil impedance. In fact, the TPU is preferably configured to sense the voltage and current load from the input devices and to automatically assign the signal to the one or more transducer lines, as appropriate.

The TPU can also be configured to sense whether the input signal from a particular device is in digital or analog form and relay the signal to the multiple voice coils in a manner appropriate for that signal. Configuration of TPU to sense the type of signal can be automatic, preprogrammed or manually selectable. Automatic detection occurs when TPU monitors each line in the bus over a predetermined period to detect whether there are more than two states (i.e., high and low) for the line. If so, the line is an analog signal. On the other hand, if there are two states detected, then the TPU can make a decision that the line is very likely a digital line. Assignment of digital lines to binary word groups can then be made by the TPU through use of additional control signals to the TPU or by predetermined arrangement. Preprogrammed configuration of TPU lines can be achieved by having a table of values stored in the TPU that identifies lines as digital or analog. Manual configuration of the TPU lines can be, for example, done through switches on speaker assembly that can be set by a user. Also, a computer can be provided as a "front end" to allow a user to configure the loudspeaker assembly by using a graphical user interface (GUI).

If a digital signal is sensed by the TPU, that signal can be applied to the loudspeaker along several paths in the manner previously described. Alternatively, if having extra equipment is not a concern, the digital signal can be converted to an analog signal with a digital-to-analog converter and then be sent to the loudspeaker along a single conductive path.

5. Multiple Function, Multiple Coil Loudspeaker/Transducer

Figure 11:
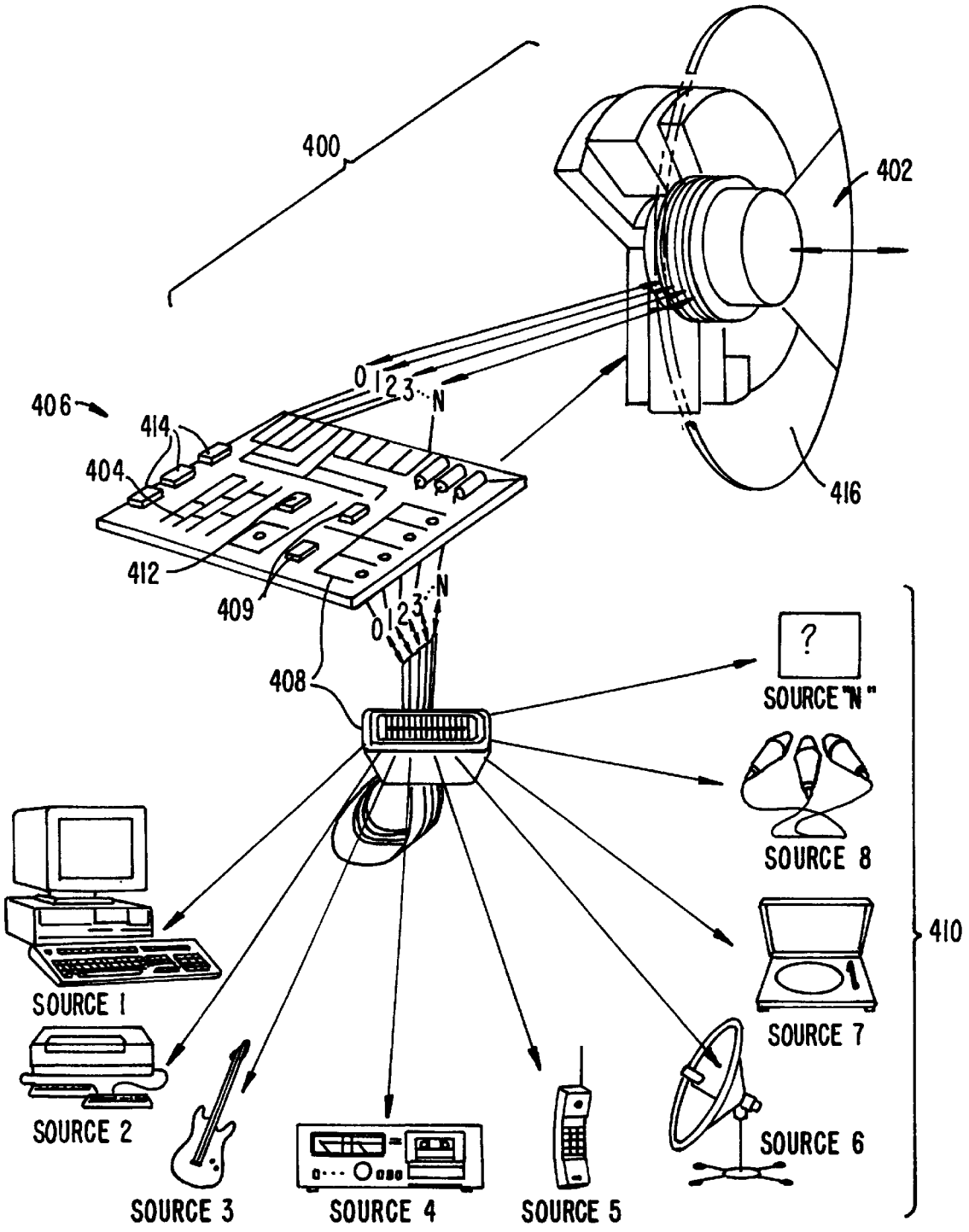
FIG. 11 is an illustration of how a multiple coil loudspeaker/transducer of the present invention can accept inputs from and send signals to a wide variety of devices.
Figure 12:
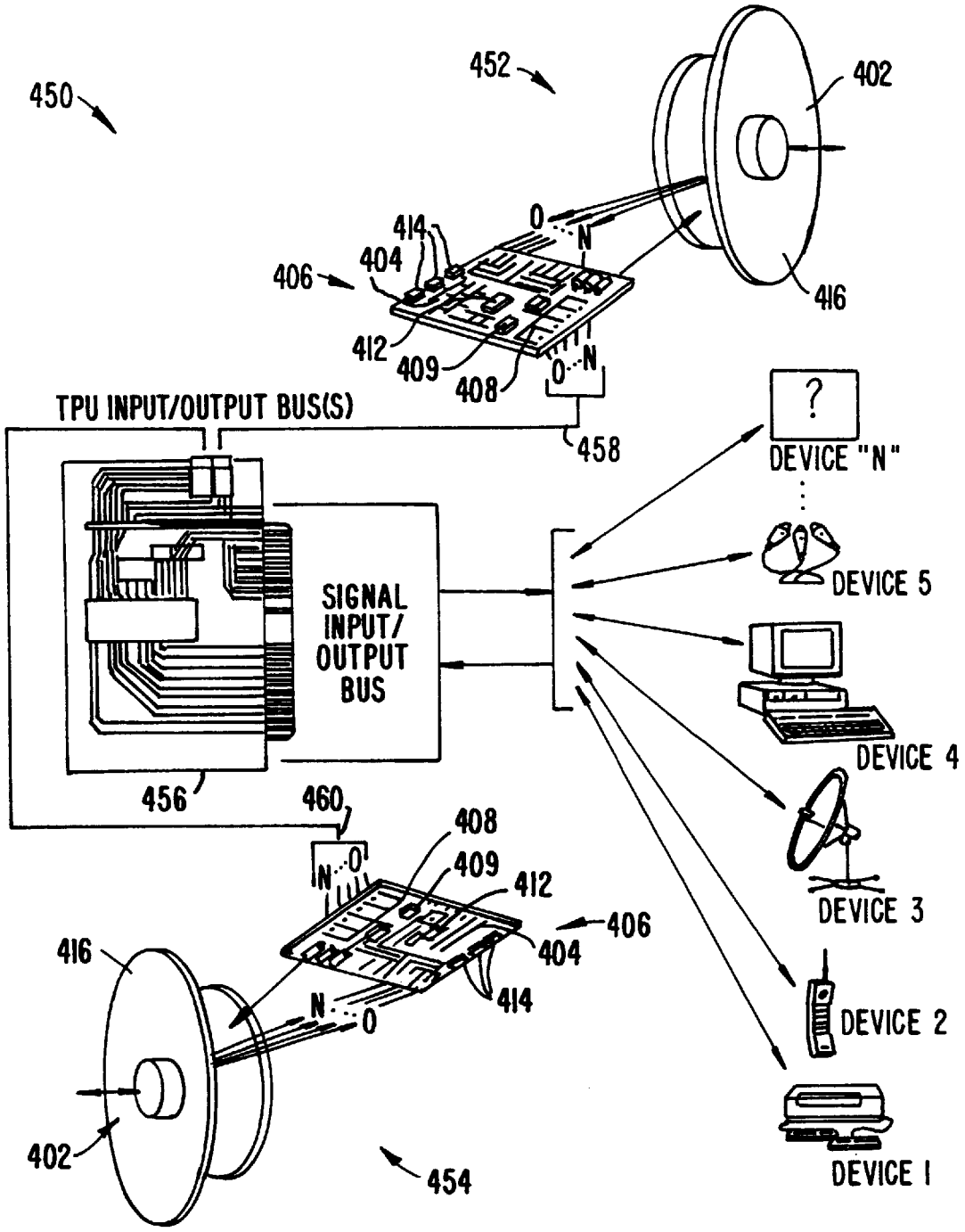
FIG. 12 shows how two multiple coil loudspeaker/transducers assemblies of the present invention can act together to accept inputs from and send signals to a wide variety of devices.

FIGS. 11 and 12 illustrate the variety of different devices that can be used with the multiple coil loudspeaker of the present invention. These devices can include such things as computers, musical instruments, receivers, telephones, antennas and microphones. FIG. 11 illustrates a loudspeaker system of the present invention using one multiple coil loudspeaker 402. The multiple coil loudspeaker 402 can receive input from sources 1 through n through bus 408 and TPU 406. The TPU 406 includes processors 409 and amplifier 404 to process and send the collected information to the multiple coil loudspeaker 402 in a way that will allow the multiple coil loudspeaker to drive its sound driver surface 416.

FIG. 12 illustrates a system 450 that includes two multiple coil loudspeakers/transducers 452 and 454 of the present invention. The loudspeakers/transducers are connected to TPU 456 by means of buses 458 and 460. Note that loudspeaker/transducer assemblies 452 and 454 may be connected to TPU 456 by many different bus arrangements. For example, a single common bus could be used where each loudspeaker has a unique address. Moreover, any number of speaker assemblies and devices can be selectively connected via TPU 456 by methods and mechanisms as are known in the art.

Because the multiple coil loudspeaker of the present invention has multiple coils, devices can activate the loudspeaker either sequentially or concurrently. During concurrent operation, two or more devices would, for example, simultaneously send signals to different coils and the sound driver surface would accordingly be activated in a way that corresponds to the composite effect of those signals.

The microphone, antenna and telephone devices illustrated in FIGS. 11 and 12 are noteworthy because they show the versatility of the present multicoil loudspeaker to not only receive input from the various sources but also to sense information and then output that sensed information to the various receiver devices. For example, returning to FIG. 8, external acoustic sound source 270 is shown generating sound waves in the direction of loudspeaker 250. When the sound waves impinge upon the sound driver surface of the loudspeaker, the vibrations imparted to any embedded voice coils can cause electrical signals to be sent along bus 252 through TPU 256 to an appropriate device. The sound pixel surface 462 of the embodiment shown in FIG. 2C can be particularly useful to sense information as a microphone, for example, while the remainder of the sound driver surface is being simultaneously driven by another device. Also, in FIG. 8, element 262 shows that the loudspeaker of the present invention can sense and relay electromagnetic signals (e.g., as an antenna) as well as acoustical signals.

Besides sensing acoustical and electromagnetic signals, the multiple coil loudspeaker of the present invention can be provided with sensors that transmit an indication of environmental factors such as temperature, pressure, humidity, vibration, to the TPU. As shown in FIG. 11, these sensors 414 can also be placed on TPU 406. The information collected from these sensors 414 can be used to modify the behavior of the loudspeaker system to compensate for changes in the air pressure or temperature, changes in positioning of the loudspeaker system or other factors to that might be useful in providing better sound reproduction.

Other types of sensors that can be used with the loudspeaker of the present invention are a proximity detector and smoke sensor. These could trigger an alarm that sounds through the loudspeaker.

It is the added capabilities of the present multiple coil loudspeaker to sense and transmit signals that makes the present multiple coil loudspeaker a true multiple function transducer, as well as a loudspeaker.

Yet another feature of the present invention is that data transfer can be wireless. Returning to FIG. 11, TPU 406 is shown with receivers 412 that can receive wireless transmission and allow them to be processed. Incidently, such wireless communication need not be by electromagnetic wave propagation but can also be, for example, by laser, infrared, or even acoustic transmissions.

It will be appreciated that many changes may be made to the system of FIG. 11 without departing from the scope of the invention. For example, receiver 412 need not be present when wireless data transfer to and from speaker system 400 is not desired. Further, subsystems other than those specifically discussed can be included in place of, or in addition to, the subsystems described. Many such variations will be apparent to one of skill in the art.

6. Integrated Systems With a Series of Multiple Coil, Multiple Function Loudspeakers/Transducers By using several multiple coil, multiple function loudspeakers/transducers of the present invention in a coordinated manner, a versatile application environment can be created that allows different sound, image and information transferring and processing functions to be performed efficiently by a single integrated system.

Figure 9:
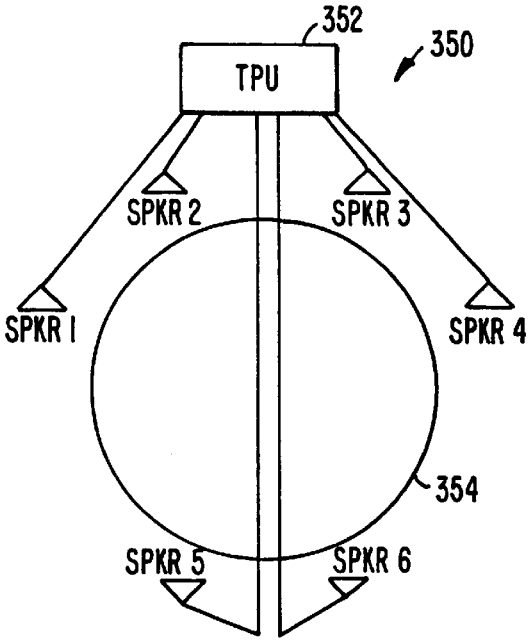
FIG. 9 illustrates a multimedia application where several multiple coil, multiple function loudspeakers/transducers of the present invention are used together.

FIG. 9 shows a diagram of a representative system 350 having six loudspeakers/transducers, Spkr 1–6, of the multiple coil, multiple function configuration already discussed of course, any number of such loudspeakers/transducers may be used. The six loudspeakers/transducers in FIG. 9 are controlled by TPU 352 which includes circuitry for both sending and receiving information from the loudspeakers/transducers in the system. Area 354 is the area where a person interacts with the system. Lines between TPU 352 and the loudspeakers/transducers represent communication links, such as wires, that allow signals to be exchanged between the loudspeakers/transducers and the TPU. The communication links may also be implemented by fiber optic cables, electromagnetic wave propagation, infrared transmission or other means.

In operation, the loudspeaker/transducer system of FIG. 9 might receive incoming satellite broadcasts or wireless communications on one or more voice coil windings within the loudspeakers/transducers that are acting as antennas. These signals might be used, for example, for a telephone conference call. In such case, the signals that are received would be routed from the applicable loudspeaker/transducer to the TPU. The TPU would process the signals and activates coils in one or more of the loudspeaker/transducers to broadcast the information received. The person within the interactive area 354 may then wish to respond to the broadcast information. This response could be picked up by a microphone input on one of the loudspeaker/transducers and routed back to the TPU 352 for satellite or other wireless transmission. Since the integrated system of the present invention uses multiple loudspeakers/transducers, spatial relationships can be established between different people in the conference call. That is, a first voice can come from the left speakers, a second voice from the right, a third from the middle and so on. The conference system can also be used with a video screen, also under the control of the TPU, so that images of, for example, documents or people talking can be shown while the conference call is in progress.

Another example of how multiple loudspeakers/transducers of the present invention can be used together is in an outdoor public address system where the density of the air determines how fast sound waves propagate. Over large distances, it is important that the multiple loudspeakers/transducers are calibrated so that a large part of the listening audience is able to hear the sound from the different loudspeakers/transducers in phase. Once detected, phase errors can be compensated for by calibrating the placement of loudspeakers and inserting an electronic delay in sound signals from a given source as it is output by different loudspeakers/transducers. For example, loudspeakers/transducers that are closer to a listener should be delayed in generating a sound signal as compared with farther loudspeakers/transducers that generate the same sound signal. In this way, wavefronts from the two loudspeakers/transducers will reach the listener at about the same time to avoid an undesirable delay in the sound. However, once the multiple speakers have been phase-corrected in this manner, a change in the air density due to temperature differences will create additional errors. The integrated speakers of the present invention can correct for such errors by using the temperature and other measurements to adjust the delay in the sound signal.

7. Novel Sub-Woofer Loudspeaker Housed in a Cylinder

Figure 10:
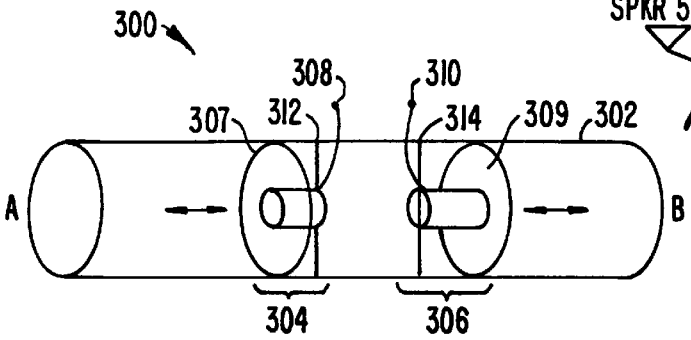
FIG. 10 shows a novel subwoofer loudspeaker arrangement in a cylindrical housing.

FIG. 10 shows an illustration of how a loudspeaker of the present invention can be constructed in a cylinder to act as an effective sub-woofer. In FIG. 10, loudspeaker assembly 300 includes a cylindrical enclosure 302 having ends A and B. Loudspeaker assembly 300 also includes loudspeakers 304 and 306 with planar sound driver surfaces 307 and 309. Leads 308 and 310 are coupled to loudspeakers 304 and 306 to input the desired electrical signals. Supports 312 and 314 hold each speaker to the wall of cylindrical enclosure 302.

In a two-loudspeaker configuration of FIG. 10, loudspeaker 304 and loudspeaker 306 are arranged so that a common electrical signal is applied to both loudspeakers simultaneously such that loudspeaker 304 generates sound waves toward end A of cylindrical enclosure 302 while loudspeaker 306 generates sound waves toward end B of cylindrical enclosure 302. Analogously, when the sound driver surface of loudspeaker 304 recedes from end A, the sound driver surface of loudspeaker 306 also recedes from end B. This enhances the intensity of low frequency waves output by the sub-woofer assembly of FIG. 10. In order to avoid destructive pressures from building up between the loudspeakers, it may be desirable to place sound absorbing material in the space between them or form holes in surface of the cylinder between them to release pressure. A single loudspeaker sub-woofer assembly would be identical to that of FIG. 10, except that only one of the loudspeakers 304 or 306 is used.

In the foregoing specification, the invention has been described with reference to a specific exemplary embodiments. It will, however, be evident that various modifications and changes may be made without departing from the broader spirit and scope of the invention as set forth in the appended claims. Many such changes or modifications will be readily apparent to one of ordinary skill in the art. The specification and drawings are, accordingly, to be regarded in an illustrative rather than a restrictive sense, the invention being limited only by the provided claims.

We claim:

1. A loudspeaker apparatus for propagating sound in response to an electric signal comprising a sound driver surface;

a voice coil former coupled to the sound driver surface;

a continuous conductor formed of conductive ink printed on a fleixable insulating surface formed of nonconducting ink which is wound concentrically around the voice coil former; and a magnetic field source oriented so that the continuous conductor is within a magnetic field, wherein the application of an electric signal to the continuous conductor creates a force that moves the voice coil former and sound driver surface causing the sound driver surface to emit sound in response to the electric signal.

2. A loudspeaker apparatus for propagating sound in response to an electric signal comprising:

a sound driver surface formed of insulating material, onto which a pattern of electrically conductive material is overlaid;

a voice coil former coupled to the sound driver surface;

a continuous conductor wound concentrically around the voice coil former; and a magnetic field source oriented so that both the conductive material on the sound driver surface and continuous conductor wound concentrically around the voice coil former are within a magnetic field, wherein the application of an electric signal to either the pattern of conductive material on the sound driver surface or the continuous conductor wound concentrically around the voice coil former creates a force that moves the sound driver surface and thereby causes the sound driver surface to emit sound in response to the electric signal.

3. The loudspeaker apparatus of claim 2, wherein the pattern of conductive material on the sound driver surface is in the form of planar coils.

4. The loudspeaker apparatus of claim 2, wherein the pattern of conductive material on the sound driver surface is in the form of conductive dots.

5. The loudspeaker apparatus of claim 4, wherein the pattern of conductive material on the sound driver surface can be activated independently of the continuous conductor wrapped concentrically around the voice coil former.

6. A loudspeaker apparatus comprising:

a sound driver surface formed of insulating material, onto which a pattern of electrically conductive material is overlaid which acts as an antenna to receive or transmit electromagnetic signals;

a voice coil former coupled to the sound driver surface;

a continuous conductor wound concentrically around the voice coil former; and a magnetic field source oriented so that both the conductive material on the sound driver surface and continuous conductor wound concentrically around the voice coil former are within a magnetic field, wherein the application of an electric signal to the continuous conductor wound concentrically around the voice coil former creates a force that moves the sound driver surface and thereby causes the sound driver surface to emit sound in response to the electric signal.

7. A loudspeaker apparatus for propagating sound in response to an electric signal comprising:

a sound driver surface;

a voice coil former coupled to the sound driver surface;

a plurality of continuous conductors wound concentrically around the voice coil former, wherein each of the plurality of continuous conductors provides an independent electrical signal path and two or more of the continuous conductors have different impedances; and a magnetic field source oriented so that each of the plurality of continuous conductors is within a magnetic field, wherein the application of an electric signal to any one of the continuous conductors creates a force that moves the voice coil former and sound driver surface causing the sound driver surface to emit sound in response to the electric signal.

8. A loudspeaker apparatus for propagating sound in response to an electric signal comprising :

a sound driver surface;

a voice coil former coupled to the sound driver surface;

a plurality of continuous conductors wound concentrically around the voice coil former wherein each of the plurality of continuous conductors provides an independent electrical signal path;

a bus coupled to the plurality of continuous conductors wherein the bus can apply a plurality of electrical signals to the plurality of continuous conductors;

a transducer processing unit which uses the bus to selectively couple a plurality of electrical signals to the plurality of continuous conductors;

an analog/digital signal detection circuit incorporated into the transducer processing unit for determining whether an analog or digital signal is being received; and, a magnetic field source oriented so that each of the plurality of continuous conductors is within a magnetic field, wherein the application of an electric signal to any one of the continuous conductors creates a force that moves the voice coil former and sound driver surface causing the sound driver surface to emit sound in response to the electric signal.

9. A loudspeaker apparatus comprising:

a sound driver surface formed of insulating material, onto which a pattern of electrically conductive material is overlaid which is adapted to act as microphone;

a voice coil former coupled to the sound driver surface;

a continuous conductor wound concentrically around the voice coil former; and a magnetic field source oriented so that both the conductive material on the sound driver surface and continuous conductor wound concentrically around the voice coil former are within a magnetic field, wherein the application of an electric signal to the continuous conductor wound concentrically around the voice coil former creates a force that moves the sound driver surface and thereby causes the sound driver surface to emit sound in response to the electrical signal.

* * * * *